US005224851A

United States Patent [19]

Johnson

[11] Patent Number: 5,224,851

[45] Date of Patent: Jul. 6, 1993

[54] LOW $NO_x$ BURNER

[75] Inventor: Gregory L. Johnson, Houston, Tex.

[73] Assignee: Shell Oil Company, Houston, Tex.

[21] Appl. No.: 880,412

[22] Filed: May 8, 1992

[51] Int. Cl.[5] ..... F23L 7/00

[52] U.S. Cl. ..... 431/115; 431/207; 431/190

[58] Field of Search ..... 431/202, 207, 163, 11, 431/115, 116, 190; 239/132.1, 132.5, 139

[56] References Cited

U.S. PATENT DOCUMENTS

| | | | |
|---|---|---|---|
| 733,463 | 7/1903 | Dennison | 431/163 |
| 1,441,629 | 1/1923 | Picard | 431/207 |
| 1,575,480 | 3/1926 | Herman | 431/207 |
| 2,894,569 | 7/1959 | Jacolev | 239/132.5 |
| 3,463,599 | 8/1969 | Welty | 431/2 |
| 3,589,314 | 6/1971 | Ottensoos et al. | 110/28 |
| 3,797,992 | 3/1974 | Straitz | 431/202 |
| 3,938,934 | 2/1976 | Frondorf | 431/11 |
| 4,089,639 | 5/1978 | Reed et al. | 431/211 |

*Primary Examiner*—Carroll B. Dority
*Attorney, Agent, or Firm*—Kimbley L. Muller

[57] ABSTRACT

A novel fuel burner is disclosed for the combustion of fuel in the presence of flue gas and water added to the nozzle tip in a liquid phase through a water outlet means at the nozzle. Steam is used as an indirect heat exchange fluid to cool the steam to water (used in the combustion) and to heat the flue gas passed to the burner. The orifices of the water outlet means are configured to insure a sufficient amount of water flow to reduce $NO_x$ (by increasing the amount of flue gas) and to insure that the flame of the burner is not extinguished.

9 Claims, 3 Drawing Sheets

LOW $NO_x$ BURNER

FIELD OF THE INVENTION

The field of this invention relates to a low $NO_x$ burner for burning a combustible fluid to reduce $NO_x$ emissions. Emission standards have become more stringent with respect to $NO_x$ emissions. A reduction in the amount of $NO_x$ per burner is significant when one realizes the number of burners involved in a refinery or manufacturing facility. The best method of reducing $NO_x$ is not to produce $NO_x$ in the first place in contrast to chemically treating the $NO_x$ by such chemicals as urea after it has been produced. This invention deals with burner technology to lower the relative amount of $NO_x$ production during burner operation.

BACKGROUND OF THE INVENTION

Prior activity in the development of low $NO_x$ burners has focused on cooling the burner flame by steam or water vapor to reduce $NO_x$ production. Flue gas has also been helpful in cooling of the burner operation. Means to increase the amount of flue gas around the burner should be encouraged. In Reed, U.S. Pat. No. 4,089,639 a burner is provided to reduce $NO_x$ which involves premixing of preheated water with fuel prior to the burning operation. Means are provided for spraying preheated water into the fuel so that water vapor will be taken up by the heated fuel in sufficient quantities to provide for a cooler burning flame and, thus, lower $NO_x$ emissions. This system is sometimes referred to as "convergent" burning and is exemplified in FIG. 1 of this application. At least four different burner embodiments are shown in the Reed patent in FIGS. (1A and B), (2A, B and C), (FIG. 3), and (FIG. 4).

A combustion process for a coal fired boiler is described in Welty, U.S. Pat. No. 3,463,599, where coal is burned so that no oxygen or sulfur trioxide is present in the resultant flue gas. A sufficient amount of additional hydrocarbons is charged to the flue gas to burn excess oxygen. By adjusting the stoichiometric quantity of hydrocarbons to oxygen, $NO_x$ is reduced. A method for burning coal dust in the presence of water vapor is described in Ottensoos et al, U.S. Pat. No. 3,598,314 which comprises heating the coal dust and water prior to passage to a nozzle at pressures and temperature conditions of just above water-vaporizing conditions so that water is pressure-relieved and vaporizes after passage through the nozzle. A heat exchange system is disclosed in Frondorf, U.S. Pat. No. 3,938,934 where combustion air fed to a fuel burner is warmed by indirect contact with warm water.

OBJECTS AND EMBODIMENTS

It is an object of this invention to provide a burner with reduced $NO_x$ output while not decreasing the efficiency of the burner.

It is a further object of this invention to provide a burner having reduced $NO_x$ emissions as a result of the presence of water added to the fuel gas and flue gas at the burner nozzle.

One aspect of this invention resides in a burner for the combustion of a fuel in the presence of flue gas and water which comprises a nozzle having a nozzle tip comprising a flue gas addition means, a fuel outlet means and a water outlet means; a fuel supply conduit means communicating with said fuel outlet means and a fuel supply reservoir; a water supply conduit means communicating with an outlet to an indirect heat exchange means and the water outlet means; an indirect heat exchange means comprising a first indirect steam contacting means communicating with said fuel supply conduit means, wherein said communication comprises positioning said indirect steam contacting means to indirectly contact fuel in said fuel supply conduit means with steam in said indirect steam contacting means; and a steam inlet means communicating with said indirect steam contacting means and a steam reservoir.

BRIEF DESCRIPTION OF THE INVENTION

This invention relates to the use of water in the liquid phase (liquid water) as a substitute for vaporous water (steam) in a nozzle admixture to burn fuel in the presence of flue gas to provide for lower $NO_x$ emissions.

DETAILED DESCRIPTION OF THE INVENTION

Burners used to combust combustible fluids rely upon the use of steam as a motive fluid to induce firebox flue gas to intermix with first-stage fuel. This results in lower flame temperatures and smaller $NO_x$ emissions. Steam is used primarily because water contamination may extinguish the flame or provide other contamination due to water system upsets.

In the instant invention, steam is utilized to heat fuel gas by means of indirect heat exchange followed by passage of the condensate water, in liquid form, (derived from the indirect heat exchange) to the burner nozzle to aid in the burning of fuel in the presence of flue gas while reducing $NO_x$ emission.

The heat exchange of steam with fuel can take place in any type of heat exchange means, although a shell and tube type heat exchanger is the most preferred. The heat exchanger can be elongated or horizontal or can comprise overlapping or interconnected coils. The only criteria of the indirect heat exchanger is that hot steam cools as it indirectly contacts the cooler fuel gas which increases in temperature as the fuel progresses towards the plenum for ultimate ignition.

The heat exchanger functions by condensing as much as 200–600 psig steam as the fuel is heated. The water collected at the bottom of the heat exchanger is discharged as a fine spray into the first-stage mixture of induced flue gas and fuel gas where it evaporates and cools this mixture providing lower $NO_x$ emissions. The presence of the water added to the end of the burner nozzle encourages the flow of flue gas to the burner nozzle tip which is advantageous to suppress flame temperature and thereby reduce $NO_x$ emissions.

There is a possibility that water flow to the nozzle tip will extinguish the flame. Thus, the end of the nozzle is designed such that the water outlet means, i.e. orifices, are present and constructed to control water flow to the area of burning. The orifice sizes should be constructed to provide a water flow rate sufficient to cool the flame, yet be designed so that water flow through the nozzle is not sufficient to snuff out the flame during normal operating conditions.

BRIEF DESCRIPTION OF THE DRAWINGS

FIG. 4 is a side view of nozzle tip of the burner of this invention which shows use of water after heat exchange passed to the nozzle tip.

DETAILED DESCRIPTION OF THE DRAWINGS

Figure 1:
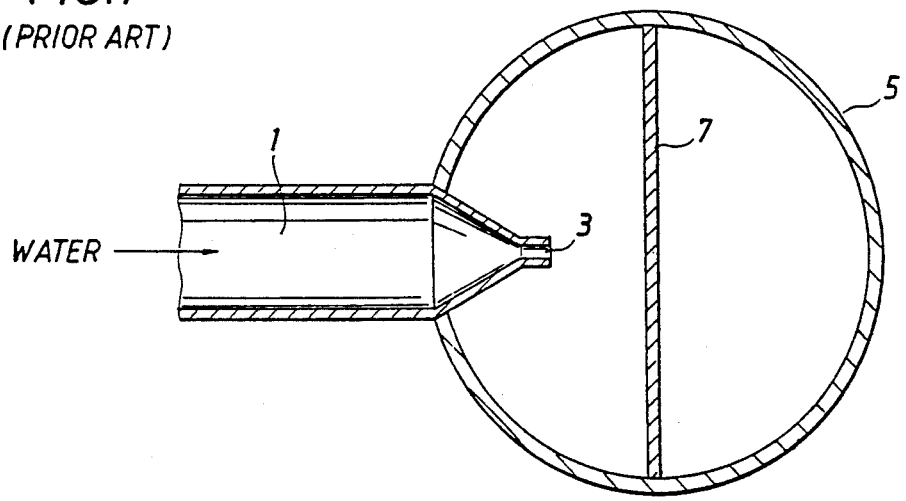
FIG. 1 (PRIOR ART)
FIG. 1 represents a water fuel admixture device as exemplified in Reed, and is labeled "PRIOR ART."

FIG. 1 demonstrates a prior art burner having water induction carried out through a conduit (1) and orifice (3) into pipe (5). The water contacts a baffle (7) causing impingement upon the baffle and a breakup of the water into tiny droplets for admixture with fuel passing through fuel pipe (5) a right angle to the water entry.

Figure 2:
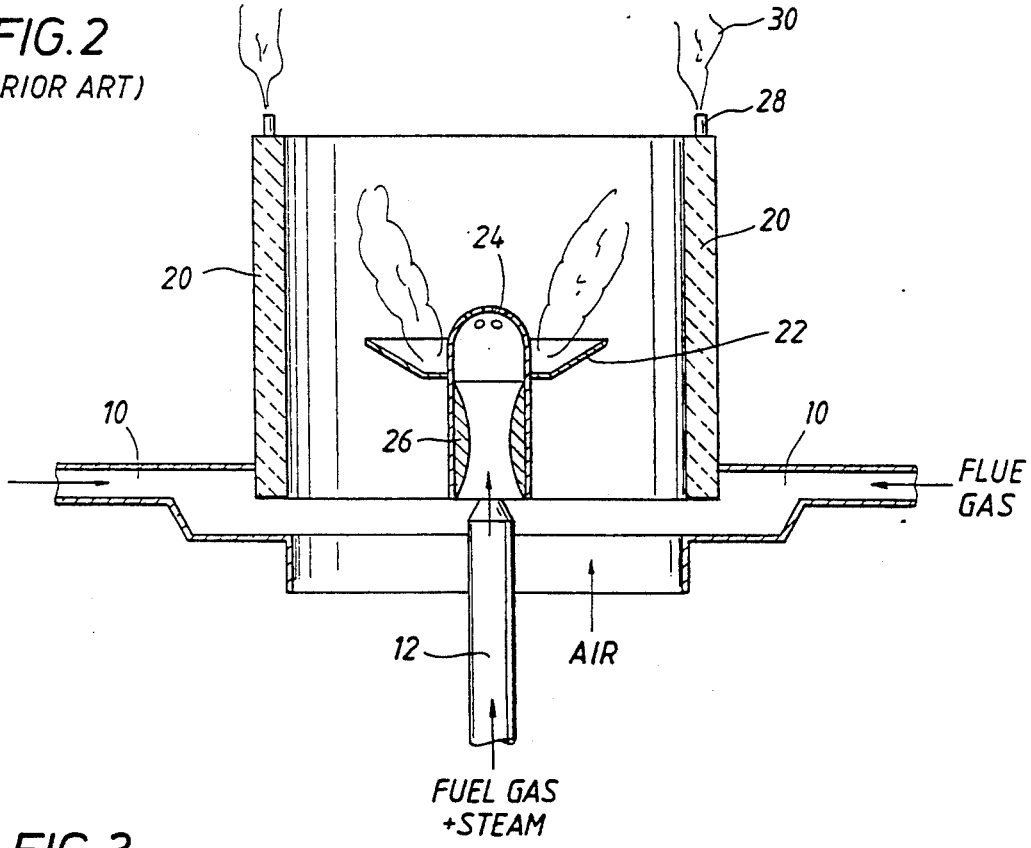
FIG. 2 (PRIOR ART)
FIG. 2 demonstrates a prior art burner complete with primary and secondary flames, and is labeled "PRIOR ART."
Figure 3:
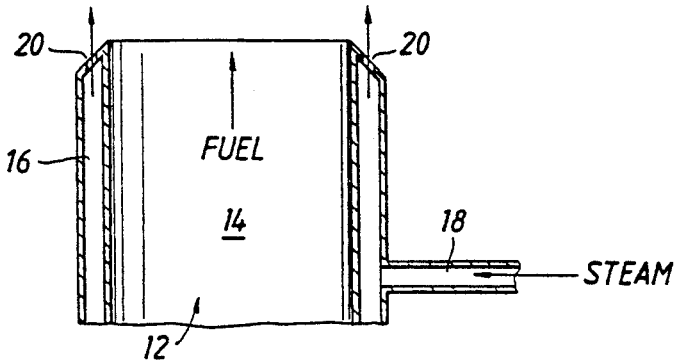
FIG. 3 (PRIOR ART)
FIG. 3 is a side view taken along line 3—3 of FIG. 2 showing the use of steam as a motive force to aid fuel combustion, and is labeled "PRIOR ART."

FIG. 2 shows a state-of-the-art fuel burner complete with primary and secondary flames. Air passes to the burner tips as shown in the drawing. Flue gas enters the primary stage of the burner from the surrounding area through conduit (10). It is desirable that the amount of flue gas passed through conduit (10) be sufficient to lower flame temperature and thereby reduce $NO_x$ emissions from the primary flame. Conduit (12) passes fuel gas and steam to the burner tip. FIG. 3 shows conduit (12) having a passageway (14) with surrounding conduit (16) for the passage of steam through conduit (18). A suitable number of orifices are located at position (20) for steam to be emitted to the tip of the nozzle. The steam passing from conduit (18) to surrounding conduit (16) acts as the motive force for induced flue gas and results in some $NO_x$ reduction at the first-stage injection nozzle.

The burner is also comprised of burner tile (20) and flame holder (22) interconnected with general distributor (24). An eductor (26) is present in the nozzle to provide for proper dispersal and flow of flue gas into fuel gas and steam mixture prior to ignition. A secondary injector is shown at (28) causing a secondary flame (30) to enhance complete combustion.

Conduit (12) of the prior art is replaced in this invention by the apparatus shown in FIG. 4. Ambient temperature combustible fuel, such as fuel gas, is added through conduit (50) to the tip of the nozzle after passing through convergent/divergent nozzle section (52) to provide supersonic flow and momentum enhancement. The fuel in conduit (50) is indirectly heated as it progresses toward the end of the nozzle. The heating process further enhances the momentum and therefore the amount of induced flue gas. As shown in FIG. 4, this heat exchange is accomplished by a shell and tube heat exchanger where the fuel is heated as it rises. The indirect heat exchange is performed by tube (56) which surrounds tube (50). The fluid in tube (56) is preferably saturated steam added by means of conduit (58). At the bottom of heat exchanger tube (56), an outlet means (58) interconnects with a water conduit (60) for passage of water to the primary stage fuel-water nozzle (62). In this nozzle, water is kept at a temperature of as much as 500° F. but under a sufficient pressure so that the water is in a liquid phase. After emission to the nozzle tip through orifices (64) the water will expand to form steam.

Figure 5:
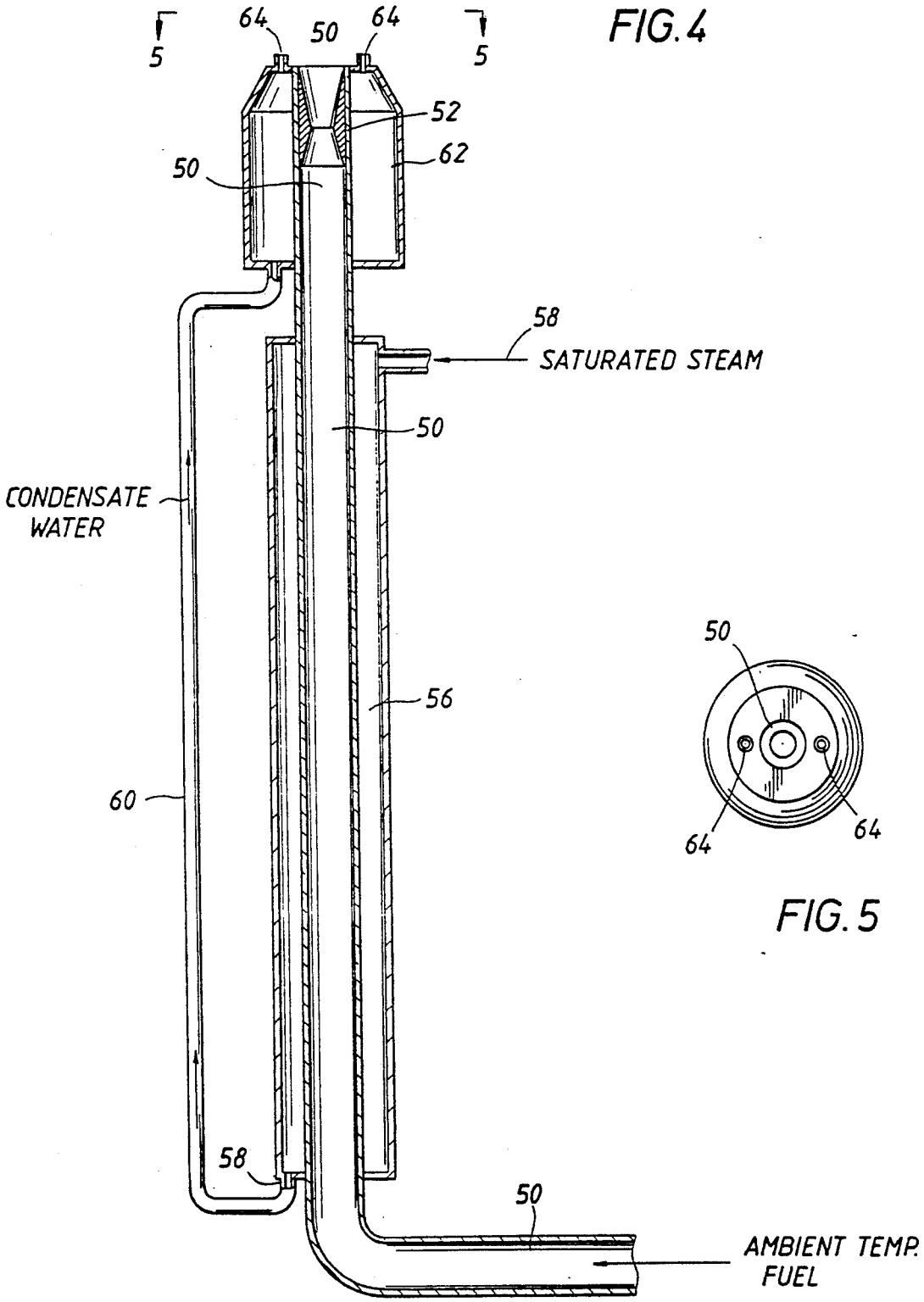
FIG. 5 is a view taken along line 5—5 of FIG. 4 showing the fuel and water orifices of the burner of this invention.
Figure 6:
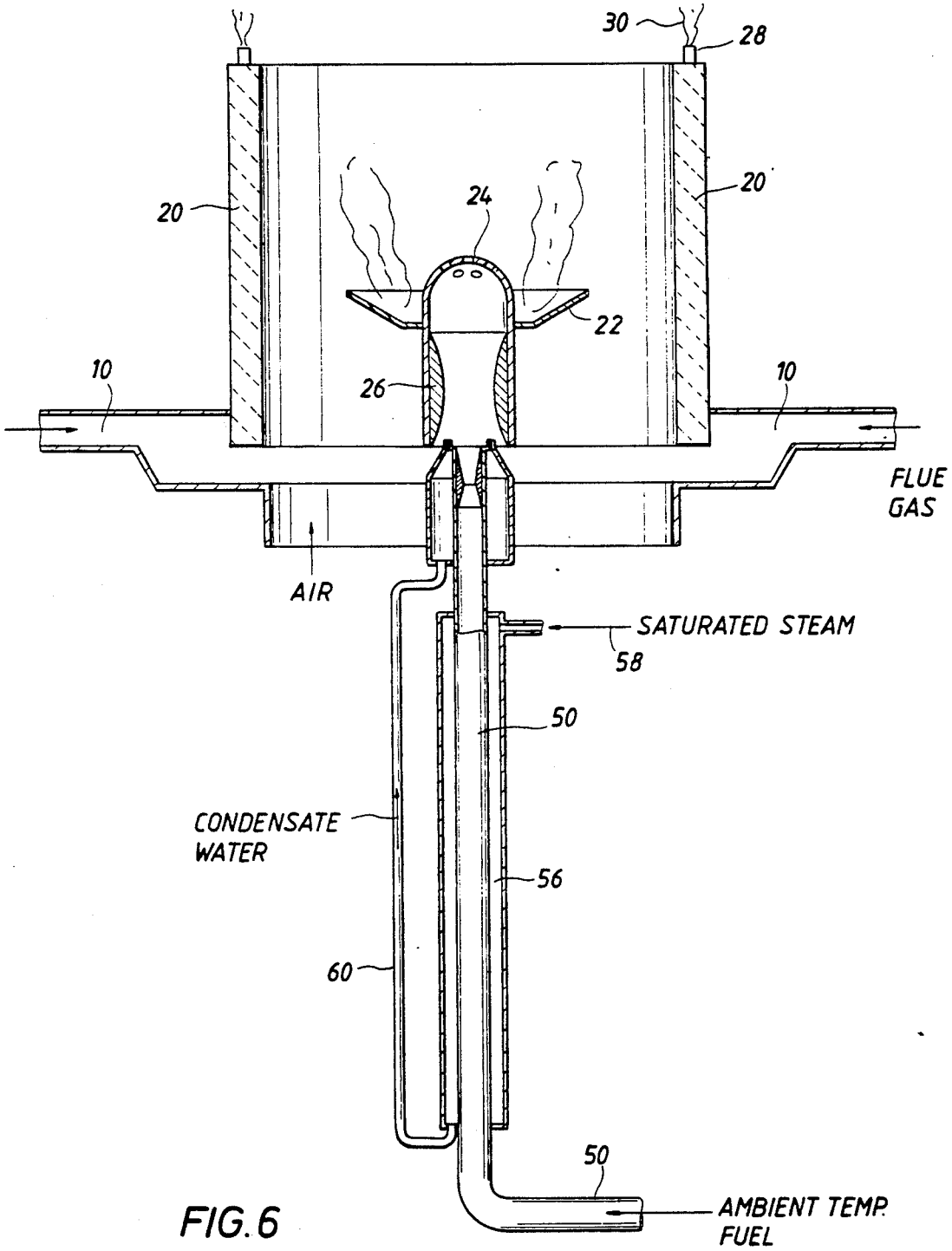
FIG. 6 in a view of the burner of FIG. 4 including means for providing flue gases to the combustion zones as in FIG. 2.

FIG. 5 shows a top view of the orifices in the nozzle tip (50 and 64). It is necessary to provide sufficient sized nozzle orifices for apertures (64) to provide a maximum amount of liquid water charged through orifices (64) to cool the induced flue gases while also limiting the orifice diameter (or number of orifices) such that an amount of water will not extinguish the flame. While two orifices are shown, any applicable number may be used depending on the diameter of the apertures (64) and the water flow required. In this invention the heated fuel gas replaces steam as a motive force which induces more flow of flue gas to mix with first stage fuel. This reduces flame temperature and therefore $NO_x$ compounds.

What I claim as my invention is:

1. A fuel burner for the combustion of a fuel to produce a flue gas in the presence of oxygen, flue gas and water which comprises:
   a. a nozzle having a nozzle tip area comprising a flue gas addition means comprising fluid communication with flue gas generated by said burner to provide for circulation of at least a portion of said flue gas from the burner to said flue gas addition means, a fuel outlet means and a water outlet means comprising multiple apertures circumferentially disposed with respect to said fuel outlet means;
   b. a fuel supply conduit means communicating with said fuel outlet means and a fuel supply reservoir;
   c. a water supply conduit means communicating with an outlet from indirect heat exchange means as further defined in Step (d) and said water outlet means;
   d. an indirect heat exchange means comprising a first indirect steam contacting means communicating indirectly with said fuel supply conduit, wherein said indirect steam contacting means is positioned so that steam in said indirect steam contacting means indirectly contacts fuel in said fuel supply conduit; and
   e. a steam inlet means communicating with said indirect steam contacting means and a steam reservoir comprising a vessel containing water which is heated to provide said steam.

2. The fuel burner of claim 1 wherein said fuel supply conduit comprises an elongated conduit having a diameter sufficient to provide the flow of fuel for burning through said elongated conduit.

3. The fuel burner of claim 1 wherein said water supply conduit comprises a flexible conduit or pipe.

4. The fuel burner of claim 1 wherein said indirect heat exchange means comprises a shell and tube heat exchanger.

5. The fuel burner of claim 1 wherein said position of said indirect steam contacting means is elongated and encompasses said fuel supply conduit.

6. The fuel burner of claim 1 wherein said steam inlet means comprises a valve and said steam reservoir comprises a vessel containing water and water vapor as a result of heat applied to said vessel containing water.

7. A burner designed to burn fuel gas to produce flue gas in the presence of oxygen, flue gas and water which comprises:
   a. a nozzle tip having a fuel gas outlet means;
   b. a first water outlet means comprising circumferentially positioned apertures about said fuel gas outlet means for emission of liquid water through said apertures to an area of fuel gas burning;

c. means connected to a source of flue gas for discharging flue gas about said nozzle tip and into the area of fuel gas burning;

d. a fuel gas supply reservoir of fuel gas communicating with said fuel gas outlet means by connection with a fuel gas conduit for passage of fuel gas from said reservoir to said fuel gas outlet means;

e. a steam supply reservoir comprising a vessel containing water which is heated to produce steam, said reservoir communicating with said water outlet means by connection with a steam-to-water conduit for passage of said produced steam to said steam-to-water conduit and removal of water from said steam-to-water conduit, wherein said steam is converted to water by:

indirect contact in a shell and tube heat exchanger where said fuel gas is heated as said fuel passes towards said fuel gas outlet means and said steam is cooled, and water is formed form said steam by condensation and said steam is removed from said steam-to-water conduit through a second water outlet means and recovered; and f. a water supply conduit communicating said second water outlet means to said first water outlet means and where said apertures in said first water outlet means are constructed to provide a sufficient amount of water through said apertures to cool said burner and increase the amount of flue gas present during burner operations but insufficient to provide an amount of water through said apertures to terminate said burning of said fuel gas in the presence of said air and flue gas.

8. The burner of claim 7 wherein said steam supply reservoir comprises a vessel containing water which is heated to steam to provide said steam to said steam-to-water conduit.

9. The burner of claim 1 wherein said fuel gas is present in said tube and said steam-water is present in said shell of said shell and tube heat exchanger.

* * * * *